United States Patent [19]

Coates

[11] 4,169,558

[45] Oct. 2, 1979

[54] WATER DISTRIBUTION CHAMBER FOR AN ELECTRIC STEAM GENERATOR

[75] Inventor: Robert N. Coates, Bellevue, Wash.

[73] Assignee: CAM Industries Inc., Kent, Wash.

[21] Appl. No.: 719,416

[22] Filed: Sep. 1, 1976

[51] Int. Cl.[2] ..... B05B 1/14

[52] U.S. Cl. ..... 239/553.5; 219/284; 219/288; 220/22; 239/557

[58] Field of Search ..... 239/553.5, 557, 565; 219/284, 288; 222/478, 564; 137/582, 574, 576; 220/22

[56] References Cited

U.S. PATENT DOCUMENTS

| | | | |
|---|---|---|---|
| 568,776 | 10/1896 | Leggett | 239/553.5 |
| 1,143,646 | 6/1915 | Poor | 137/574 |
| 1,335,267 | 3/1920 | Ambrose et al. | 239/553.5 |
| 2,527,409 | 10/1950 | Ellinwood et al. | 220/22 X |
| 2,903,166 | 8/1959 | Kuljian | 222/478 |
| 3,554,444 | 1/1971 | Hochman | 239/553.5 |
| 3,744,724 | 7/1973 | Caille | 239/553.5 |

FOREIGN PATENT DOCUMENTS

| | | | |
|---|---|---|---|
| 728299 | 10/1942 | Fed. Rep. of Germany | 219/288 |
| 12547 | of 1907 | United Kingdom | 220/22 |

*Primary Examiner*—Bruce H. Stoner, Jr.
*Assistant Examiner*—Michael J. Forman
*Attorney, Agent, or Firm*—Kenyon & Kenyon

[57] ABSTRACT

Horizontal damping elements are arranged in the water distribution chamber to damp out wave action in the water flowing to the individual compartments formed by vertical baffles. The damping elements may be integral with the baffles to form one-piece members or may be formed of flat plates separate from the baffles. The dampening elements prevent periodic fluctuations from occurring in the water streams from which steam is produced and thus fluctuations in the amounts of generated steam.

5 Claims, 6 Drawing Figures

WATER DISTRIBUTION CHAMBER FOR AN ELECTRIC STEAM GENERATOR

This invention relates to an electric steam generator and more particularly to a water distribution chamber for an electric steam generator.

As is known, electric steam generators generally produce steam by passing an electric charge through one or more flowing streams of water to cause a portion of the water to change to steam. In many cases, these steam generators employ water distribution chambers in order to form a plurality of streams from which steam can be generated. In one such case, a water distribution chamber has been formed with several compartments which are separated by baffle plates each of which has a horizontal overflow edge. In addition, the overflow edges of these baffle plates have been staggered in an increasing step-wise manner in the flow direction. Also, each compartment has been provided with one or more outlet nozzles to discharge one or more streams of water. The staggering of the baffles in height allows the compartments to adapt to the amount of water delivered to the distribution chamber so that at partial loads, only some of the chambers are filled.

However, in water distribution chambers of this type, surface waves can develop which can lead to periodic fluctuations in steam production. Further, particularly unfavorable conditions can arise in electric steam generators which are operated with three-phase power when longitudinal oscillations occur in feed water supply chambers which precede the individual distribution chambers since this can then lead to a fluctuation in the distribution of the load over the individual phases.

Accordingly, it is an object of the invention to reduce fluctuations in the steam production in an electric steam generator.

It is another object of the invention to substantially reduce the chance of fluctuations occuring in the distribution of the load in a multi-phase power operated electric steam generator.

It is another object of the invention to eliminate wave action in water distribution chambers for electric steam generators.

It is another object of the invention to provide a simple means of eliminating wave action in the water distribution chambers of electric steam generators.

Briefly, the invention provides a water distribution chamber for an electric steam generator which has a plurality of baffles forming a plurality of compartments with at least one outlet nozzle in a bottom of each compartment for an outflow of a stream of water and with damping elements to damp surface waves in the water flowing to and through the compartments. The distribution chamber also has an inlet at one end for receiving a flow of water and the damping elements are disposed between the inlet and the baffles.

The damping elements which are of planar, i.e. flat construction extend in the inflow direction of the water towards the baffle and are arranged horizontally or at a slight incline to a horizontal plane. By placing the damping elements in the inlet zone of the distribution chamber, damping of any surface waves can be obtained in a simple manner. Thus, the tendency of the chamber and the generator to fluctuate is effectively reduced.

The damping elements may be integrally formed with the baffles as one-piece members or may be made separate from the baffles.

These and other objects and advantages of the invention will become more apparent from the following detailed description and appended claims taken in conjuction with the accompanying drawings in which:

Figure 1:
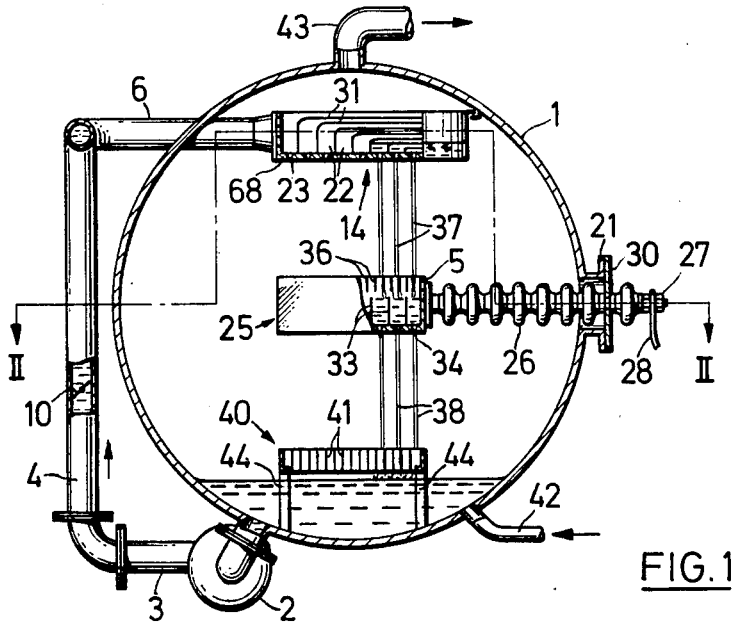
FIG. 1 illustrates a view taken on line I—I of FIG. 2 of an electric steam generator with a water distribution chamber in accordance with the invention.

Referring to FIG. 1, the electric stream generator has a horizontally arranged cylindrical vessel 1 to which a circulating pump 2 is connected near the lowest point. The circulating pump 2 has an output stub 3 which connects to a feedpipe 4 in which a throttle 10 is disposed. The feed pipe 4 branches at the upper end, into two branch lines 6, 7 (FIG. 2) which are connected via a diffusor 11 and 12, respectively, to a distribution tank 14 which is open at the top. The distribution tank 14 is substantially rectangular in top view and extends horizontally in the longitudinal direction of the cylindrical vessel 1. The tank 14 consists essentially of a bottom 68, two long walls 69, 70 as well as of two side walls 71.

Figure 2:
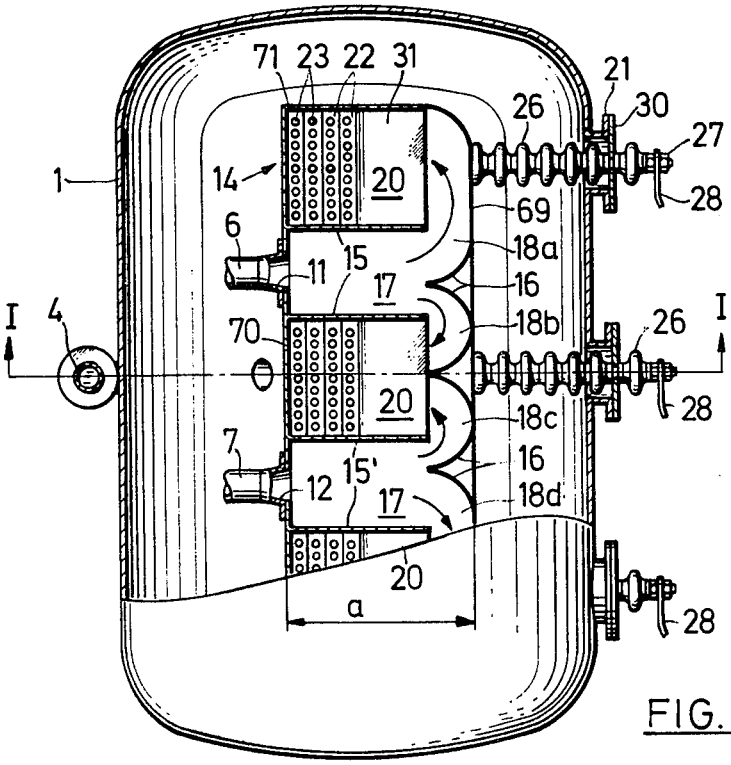
FIG. 2 illustrates a horizontal cross-sectional view taken on line II—II of FIG. 1.

As shown in FIG. 2, a pair of partitions 15, 15' are provided on both sides of the mouths of the two branch lines 6, 7. These partitions 15, 15' extend from the wall 70 parallel to each other over a length a which is approximately three-fourths of the width of the tank 14. The two pairs of partitions define respective supply basins 17 adjacent to the corresponding mouth. Four curved baffles are arranged at the wall 69 of the distribution tank 14 opposite the mouths of the two branch lines 6 and 7. These four curved baffles 16 are arranged in such a manner that four deflection channels **18*a*, 18*b*, 18*c*, 18*d* for the water are formed, which lead from the two supply basins 17 to three water distribution chambers 20. As shown, two of the chambers 20 are located at the two ends of the distribution tank 14 while the third is located between the two supply basins 17**.

Referring to FIGS. 1 and 2, three electrodes 25 are located underneath the distribution tank 14 about at the height of the horizontal axis of the cylindrical vessel 1. These three electrodes 25 are each associated with a distribution chamber 20 and are attached to insulators 26 which protrude into the vessel 1. Each insulator 26 surrounds a rod-shaped conductor 27 which is connected to an electric current lead 28 at the end outside the vessel and to an electrode 25 at the other end. Each insulator 26 is fastened in a cover 30 which is tightly connected to a flange 21 of a vessel stub by means of screws (not shown).

Each electrode 25 consists of a box 5 open at the top, which is divided by vertical walls 33 into individual compartments which extend lengthwise in the vessel 1. A row of nozzle openings 34 is provided in the bottom of each compartment. Mutually parallel rods 36 are arranged in the box 5 above the vertical walls 33 and run parallel to the walls 33 to form a contact grid. A grid 40 is provided underneath each electrode 25 and consists of a frame and parallel rods 41 therein. The frame is mounted in the vessel 1 by means of vertical legs 44. The distance between the underside of the electrode 25 and the top side of the grid 40 is approximately equal to the distance between the upper side of the electrode 25 and the underside of the distribution tank 14. The vessel 1 is provided at the underside with a feed water line 42 and has a steam discharge stub 43 at the upper side which is connected to a steam consumer (not shown).

Figure 3:
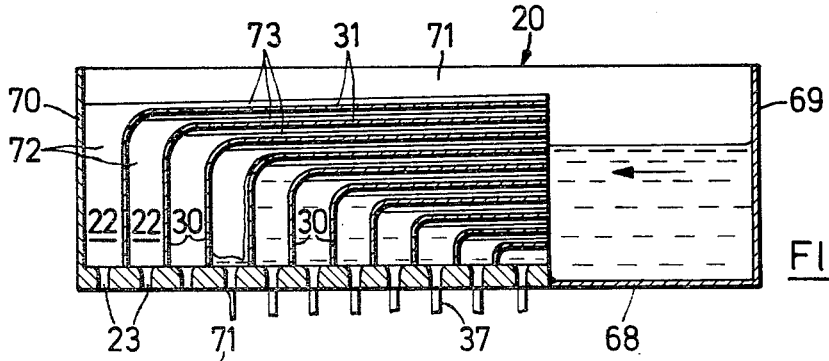
FIG. 3 illustrates a view taken on line III—III of FIG. 4 of a water distribution chamber according to the invention.

Referring to FIG. 3, each chamber 20 has an inlet at one end for receiving a flow of water as well as a plurality (eg. ten) of planar i.e. flat one piece members which form vertical partitions or baffles 30 which extend in the longitudinal direction of the vessel 1 and form eleven compartments 22 of different heights. The height of the compartments 22 increases in step-wise manner from the water inlet side in equal steps. A row of discharge nozzles 23 is arranged in the bottom of each compartment 22 and each is rounded and flared out in funnel-fashion toward the top. Cross-shaped or wavy inserts can be attached in each nozzle 23 such as are commonly used in the outlets of water fittings for quieting the flow. The upper ends of the members form plates 31 which extend in the direction of the flowing water and have a slight rise starting from a respective baffle 30. The plates 31 form damping or quieting elements, which damp possible wave motions of the water level. The damping elements 30, 31 are tightly connected to the adjoining partition 15 and the outer confining wall 71 of the distribution tank 14 as well as to the bottom. As shown, the damping members are disposed in overlying relation to define a plurality of water receiving compartments downstream of the inlet.

Figure 4:
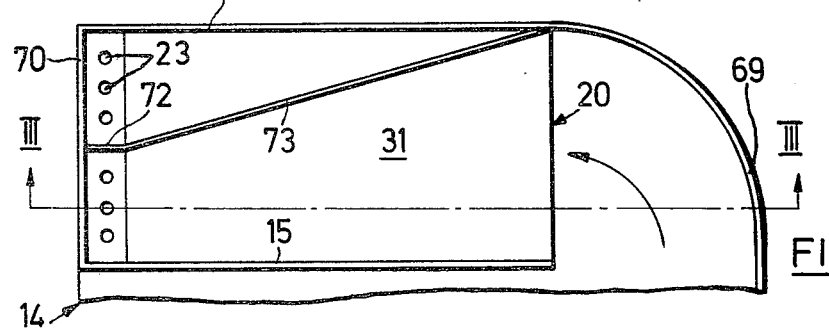
FIG. 4 illustrates a top view of the water distribution chamber of FIG. 3.

Referring to FIG. 4, a transverse dam in the form of a vertical plate 72 extends upward through each compartment and continues at the upper end into a sheet metal strip 73 to form a dam bar. The sheet metal strip 73 runs from the plate 72 toward the inlet side of the water chamber 20 at an angle to the outer confinement wall 71. The height of this dam bar 73 is about half of the clearance between two adjacent plates 31. The upper edge of the dam bars 73 has about the same inclination as the adjacent sheets 31. Each dam bar 73 extends with an empirically determined height and inclination so that the water, upon reaching the top of the dam bar 73 between two plates 31, begins to flow over the dam bar 73 over the entire length. The plates 72, 73 subdivide each compartment 22 and allows a very fine matching of the water supply to the operation of the steam generator at low partial load. In addition, the dam bars 73 act as supplemental oscillation dampers for the water.

Figure 5:
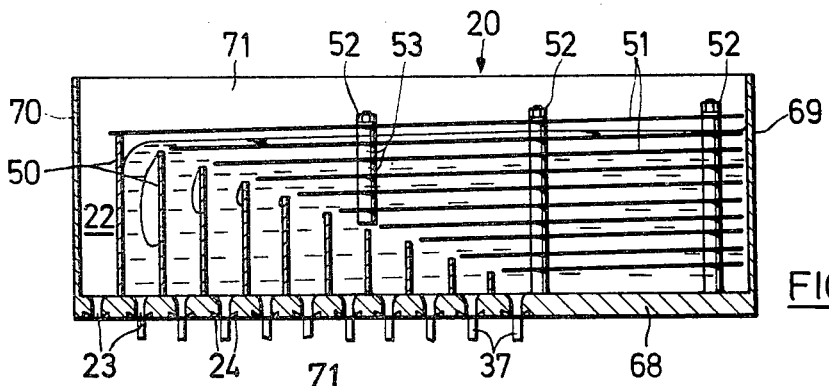
FIG. 5 illustrates a view taken on line V—V of FIG. 6 of a modified embodiment of the water distribution chamber according to the invention.
Figure 6:
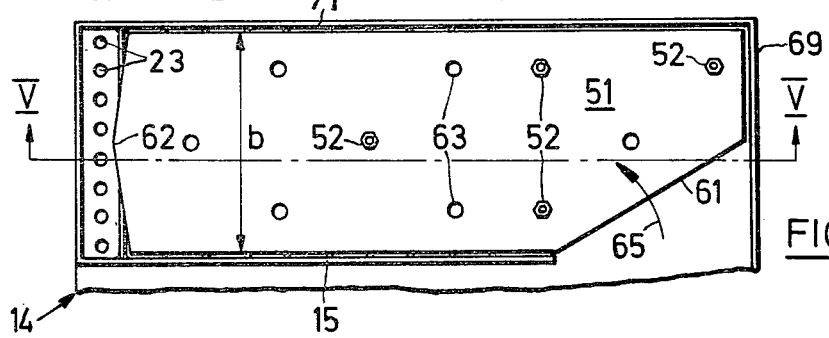
FIG. 6 illustrates a top view of the water distribution chamber of FIG. 5.

Referring to FIGS. 5 and 6, the damping elements may be made separate from the baffle plates 50. As shown, the damping elements are in the form of flat planar plates 51 which form a packet. For this purpose, the damping plates 51 are held in vertically spaced apart relation by bolts 52 and spacers 53 which are arranged between the plates 51 and surround the bolts 52. The spacing is equal to the height difference from one compartment to the next.

While the uppermost plate 51 forms an obtuse angle at the end 62 and rests with this end on the corresponding baffle plate 50, the other plates 51 extend only to near the overflow edge of the corresponding baffle plate 50. The width b of the plates 51 is practically equal to the inside width of the distribution chamber 20, so that the packet of plates 51 can be lifted out of the chamber, while the baffles 50 are connected tightly to the walls 15 and 71 as well as to the bottom 68. The ends of the damping plates 51 to the right in FIG. 5 extend close to the longitudinal wall 69. The plates 51 are provided with a bevelled edge 61 at the water inlet ends in order to equalize the flow over the width of the distribution chamber 20. The velocity-dependent friction of the water entering in the direction of the arrow 65 absorbs the energy of possible waves so that the water does not fall as a wave into the last compartment 22, which is only partly occupied. The plates 51 are each provided with six passage openings 63 which have an additional damping effect. in addition, the openings 63 correct any slope of the plates 51 that may not be entirely correct.

As shown in FIGS. 5 and 6, the distribution chamber is further modified so that the lower end of each nozzle opening 23 is undercut by a low conical surface 24 to form a sharp exit edge which does not have the tendency to "attract" water.

Instead of using flat plates 51, flat screen or wire mesh may also be used for the damping elements. It is also possible to provide more damping elements than there are baffle plates.

Referring to FIGS. 1 and 2, in the operation of the steam generator, feed water is supplied under pressure via the feed water line 42, the amount fed-in being influenced by control elements (not shown) in such a manner that the level in the vessel 1 remains below the grids 40 and does not leave a predetermined range. The circulating pump 2 draws water from the sump in the vessel 1 and pumps the water via the throttle 10 and the two branch lines 6, 7 into the two supply basins 17. From these supply basins 17, the water passes via the deflection channels **18*a* to 18*d* to the three water distribution chambers 20 where, optionally as a function of the load, a given level adjusts itself. Depending on the level, the water then enters only the first compartment (as seen in the flow direction) or several compartments 22 or all compartments 22, whereupon the water discharges through a row or several or all rows, of nozzle openings 23 in the form of closed jets or streams 37 and falls on the contact grid rods 36 of the associated electrode 25. In the electrode 25, the water is distributed over the compartments which are formed by the partitions 33, the number of which is equal to that in the distribution chambers 20, the same number of nozzle holes 34 being provided in each compartment of the electrodes as in the compartments 22 of the chambers 20. Thus, the same number of water jets 38 results which fall from the electrodes 25 onto the grids 40. The water reaching the grids 40 then passes unimpeded into the sump of the vessel 1. Three-phase current is then fed to the electrodes via the leads 28 and the rod-shaped conductors 27 and flows in part through the water jets 37 to the water distribution chambers 20 and in part through the water jets 38 to the grids 40. The distribution tank 20 as well as the grids 40 are electrically connected to the vessel 1 and have center tap potential or, if the vessel 1 is grounded, ground potential. When current flows through water jets, steam is generated which collects above the distribution tank 14 and leaves the vessel 1 via the discharge stub 43**.

The circulating pump 2 is constructed so that by operating the throttle 10, the amount of water pumped to the distribution chambers 20 can be set between a minimum load of about 5% and full load of 100%.

The invention thus provides a water distribution chamber in which a level of water which might otherwise be subject to waves or fluctuations caused by various disturbances is maintained in a quiet state. The damping elements (31, 51) which are placed at the inlet region of the water distribution chambers achieve substantial damping of any wave action that might occur. In the embodiment as shown in FIG. 2, this damping effect is further aided by the curved baffles 16.

What is claimed is:

1. A water distribution chamber for an electric steam generator, said chamber having an inlet at one end for receiving a flow of water;

a plurality of baffles forming a plurality of compartments downstream of said inlet, each said baffle having a horizontal overflow edge, said edges of said baffles being disposed in stepwise increasing height relative to the inflow direction of the flow of water;

at least one outlet nozzle in a bottom of each compartment for an outflow of a stream of water;

a plurality of flat damping elements of equal number to said baffles between said inlet and said baffles, said damping elements extending in said inflow direction towards said baffles to damp surface waves with each damping element being a sheet metal plate integral with a respective baffle to form a one-piece body therewith; and a transverse dam in each compartment extending vertically to a height midway between two adjacent damping elements, each said dam extending at an angle through said respective compartment.

2. A water distribution chamber as set forth in claim 1 wherein said damping elements are horizontally disposed.

3. A water distribution chamber as set forth in claim 1 wherein said damping elements are disposed at a slight incline to a horizontal plane.

4. A water distribution chamber as set forth in claim 1 wherein each said damping element has a plurality of openings.

5. A water distribution chamber for an electric system generator, said chamber having an inlet at one end for receiving a flow of water;

a plurality of vertically disposed baffles downstream of said inlet, said baffles being of increasing height relative to the inflow direction of a flow of water from said inlet to define a plurality of compartments therebetween;

a plurality of vertically spaced apart flat plates extending between said baffles and said inlet to define separate flow channels, each said flow channel communicating with a respective compartment;

at least one outlet nozzle in a bottom of each compartment for an outflow of a stream of water; and a transverse dam in each compartment extending vertically to a height midway between two adjacent plates, each said dam extending at an angle through said respective compartment.

* * * * *

UNITED STATES PATENT AND TRADEMARK OFFICE

CERTIFICATE OF CORRECTION

PATENT NO. : 4,169,558

DATED : October 2, 1979

INVENTOR(S) : Robert N. Coates

It is certified that error appears in the above-identified patent and that said Letters Patent are hereby corrected as shown below:

Column 2, lines 6 - 7, change "conjuction" to --conjunction--

Column 2, line 23, change "stream" to --steam--

Column 2, line 39, change second occurrence of "a" to an italicized --a--

Column 4, line 17, change "in" to --In--

Signed and Sealed this

*Eighth* Day of *January 1980*

[SEAL]

*Attest:*

SIDNEY A. DIAMOND

*Attesting Officer*

*Commissioner of Patents and Trademarks*